US009738111B2

(12) United States Patent
Jackson

(10) Patent No.: US 9,738,111 B2
(45) Date of Patent: Aug. 22, 2017

(54) FLEXIBLE MARKERS

(71) Applicant: Daniel Travis Jackson, Brooklyn, NY (US)

(72) Inventor: Daniel Travis Jackson, Brooklyn, NY (US)

( * ) Notice: Subject to any disclaimer, the term of this patent is extended or adjusted under 35 U.S.C. 154(b) by 0 days.

(21) Appl. No.: 14/709,454

(22) Filed: May 11, 2015

(65) Prior Publication Data

US 2015/0328917 A1 Nov. 19, 2015

Related U.S. Application Data

(60) Provisional application No. 61/992,251, filed on May 13, 2014.

(51) Int. Cl.

| | |
|---|---|
| ***B43K 23/008*** | (2006.01) |
| ***B43K 7/00*** | (2006.01) |
| ***B43K 8/02*** | (2006.01) |
| ***B43K 8/00*** | (2006.01) |
| ***B43K 21/00*** | (2006.01) |
| ***B43K 23/004*** | (2006.01) |
| ***B43K 29/007*** | (2006.01) |
| ***B42D 9/00*** | (2006.01) |

(52) U.S. Cl.

CPC ..... *B43K 7/005* (2013.01); *B42D 9/007* (2013.01); *B43K 8/003* (2013.01); *B43K 8/02* (2013.01); *B43K 21/006* (2013.01); *B43K 23/004* (2013.01); *B43K 29/007* (2013.01)

(58) Field of Classification Search

CPC ..... B43K 23/001; B43K 23/02

USPC ..... 401/6, 8, 195

See application file for complete search history.

(56) References Cited

U.S. PATENT DOCUMENTS

| | | | | | |
|---|---|---|---|---|---|
| 1,367,872 | A * | 2/1921 | Glaesser | B43L 15/00 | 401/6 |
| 3,168,072 | A * | 2/1965 | Nitta | B43K 19/14 | 401/6 |
| 4,508,464 | A * | 4/1985 | Money | B42D 9/007 | 40/334 |
| 4,568,213 | A * | 2/1986 | Money | B42D 9/007 | 401/202 |
| 5,988,918 | A * | 11/1999 | Johnson | B43K 5/005 | 401/88 |
| 7,316,516 | B2 * | 1/2008 | Regala | A45C 11/18 | 401/131 |
| 9,067,458 | B1 * | 6/2015 | Mock | B43K 23/008 | |

(Continued)

*Primary Examiner* — David Walczak
*Assistant Examiner* — Joshua Wiljanen
(74) *Attorney, Agent, or Firm* — NK Patent Law, PLLC

(57) ABSTRACT

A flexible marker includes a flexible body for gripping, and a marking implement carried at least partially within the body. The body is flexible to conform to the grip preferences of a user. The body has two parallel lateral sides and a first longitudinal end defining a central apex from which the marking implement can be extended. The body can be folded along or near a central longitudinal axis to bring together two lateral sides. The body can be folded along a first laterally extending axis in a first configuration in which the marking implement extends longitudinally beyond a second longitudinal end for use of the marking implement. The body can be folded along a second laterally extending axis in a second configuration in which the second longitudinal end extends longitudinally beyond the marking implement.

16 Claims, 2 Drawing Sheets

(56) References Cited

U.S. PATENT DOCUMENTS 9,120,347 B1 * 9/2015 Mock ..... B43K 21/006
9,186,929 B1 * 11/2015 Mock ..... B43M 3/045

* cited by examiner

FLEXIBLE MARKERS

CROSS-REFERENCE TO RELATED APPLICATION

This application claims the benefit of priority of U.S. provisional patent application No. 61/992,251, titled "Flexible Markers" filed on May 13, 2014, which is incorporated herein in its entirely by this reference.

TECHNICAL FIELD

The present disclosure relates to markers having outer forms that are adaptable to the hand. More particularly, the present disclosure relates to a marker having a flexible body that is foldable.

BACKGROUND

Typical pens, pencils, highlighters and other markers have narrow cylindrical bodies which do not conform to the hand of a user or comfortably permit hand position adjustment in use. Sustained use of an inflexible marker can cause hand fatigue even to an otherwise healthy human hand. For example, using a typical pen can cause or exasperate conditions such as carpal tunnel syndrome. Someone suffering from a hand injury or disability condition, whether chronic or temporary, may be unable to comfortably grasp a typical marker or may be unable to close a hand on a marker with sufficient closure and force to wield the marker.

Typical markers also have very limited external surface areas, due to their narrow cylindrical forms. Even where advertising or other informational and graphical content is applied to the exterior of a marker, the available area is so limited that either only little content can be applied or the content must be presented in very small print or size.

Furthermore, pens and other markers may be cumbersome to carry around in one's pocket. A more convenient method for storing a pen on a person would be advantageous.

SUMMARY

This Summary is provided to introduce in a simplified form concepts that are further described in the following detailed descriptions. This Summary is not intended to identify key features or essential features of the claimed subject matter, nor is it to be construed as limiting the scope of the claimed subject matter.

In at least one embodiment, a flexible marker includes a flexible body for gripping, and a marking implement carried at least partially within the body. The body is flexible to conform to the grip preferences of a user. In at least one example, the body has two parallel lateral sides and a tapered longitudinal end defining a central apex from which the marking implement can be extended. In at least one example, the body can be folded along or near the longitudinal axis to bring together the lateral sides.

In at least one embodiment, a flexible marker includes: a flexible body for gripping; and a marking implement carried at least partially within the body, wherein the body is flexible to conform to the grip preferences of a user.

In at least one example, the body has two parallel lateral sides and a tapered longitudinal end defining a central apex from which a tip of the marking implement extends.

In at least one example, the body is thicker along a longitudinally extending central portion than along the lateral sides.

In at least one example, the body includes a generally planar face, and an arched face opposite the generally planar face.

In at least one example, the body can be folded along or near a longitudinally extending axis defined approximately centrally between two parallel lateral sides.

In at least one example, a pre-formed fold line is defined by the body along the longitudinally extending axis.

In at least one example, the body can be configured into either one of two overlapping configurations by folding the body along or near either of two respective laterally extending pre-formed fold lines defined by the body.

In at least one example, when folded at a first of the two laterally extending pre-formed fold lines, a longitudinal end of the body overhangs a tip of the marking implement to prevent use of the marking implement.

In at least one example, when folded at a second of the two laterally extending pre-formed fold lines, a tip of the marking implement overhangs a longitudinal end of the body to permit use of the marking implement.

In at least one example, the body includes a foldable panel having an end from which the marking implement extends; and when folded in at least one configuration, a portion of the panel extends beyond the marking implement.

In at least one embodiment, a flexible marker includes: a flexible panel having a first longitudinal end and a second longitudinal end, the flexible panel configurable between a generally flat configuration and at least one flexed or folded configuration; and a marking implement extendable from the first longitudinal end.

In at least one example, the flexible panel can be flexed or folded along a longitudinal axis for use of the marking implement.

In at least one example, the flexible panel can be flexed or folded along a first laterally extending axis in a first configuration in which the marking implement extends longitudinally beyond the second longitudinal end for use of the marking implement.

In at least one example, the flexible panel can be flexed or folded along a second laterally extending axis in a second configuration in which the second longitudinal end extends longitudinally beyond the marking implement.

In at least one example, the flexible panel defines a first laterally extending pre-formed fold line at the first laterally extending axis and a second laterally extending pre-formed fold line at the second laterally extending axis.

In at least one example, the body has two parallel lateral sides, and the first longitudinal end tapers from the two parallel lateral sides to a longitudinally extending central apex from which a tip of the marking implement is extendable.

In at least one example, the second longitudinal end is straight edged.

In at least one example, the flexible panel is thicker along a longitudinally extending central portion than along lateral sides.

In at least one example, the flexible panel includes a generally planar face, and an arched face opposite the generally planar face.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

Figure 4:
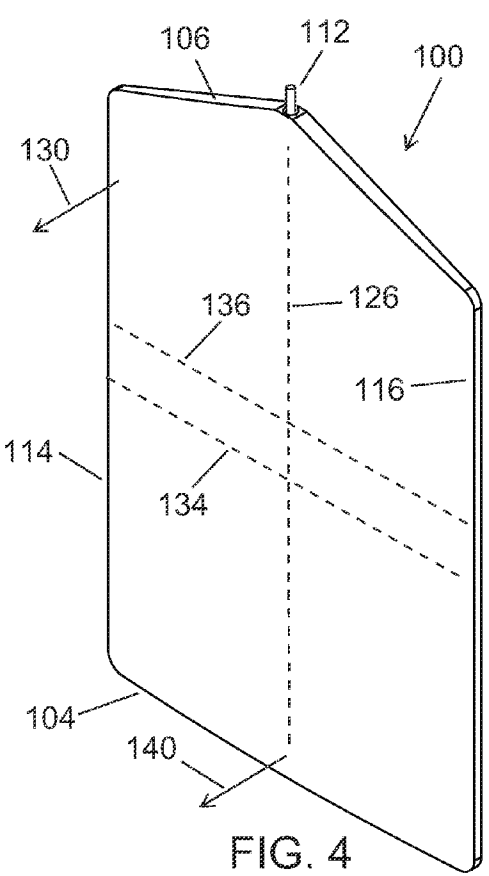
FIG. 4 is a perspective view of the flexible marker of FIG. 1.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although the term "step" may be expressly used or implied relating to features of processes or methods, no implication is made of any particular order or sequence among such expressed or implied steps unless an order or sequence is explicitly stated. Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing. Like reference numbers used throughout the drawings depict like or similar elements.

Figure 1:
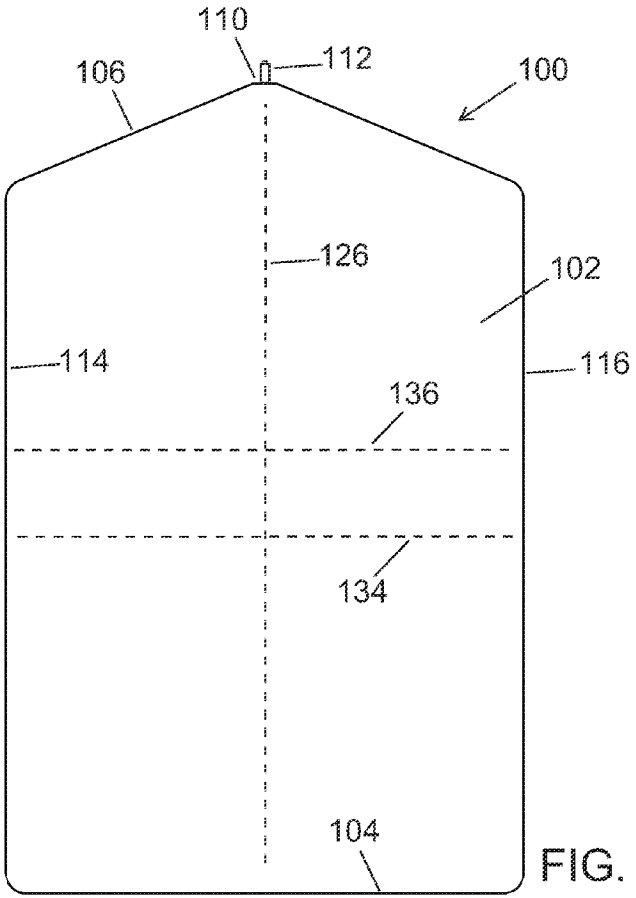
FIG. 1 is a plan view of a flexible marker according to at least one embodiment.

FIG. 1 is a plan view sketch of a flexible marker 100 according to at least one embodiment. As shown, the flexible marker has a card-like panel or large-area gripping body 102 having a linear longitudinal end 104, a tapered longitudinal end 106 defining a central apex 110 from which a marker tip 112 extends. The body 102 has two parallel lateral sides 114 and 116. Edges of the body 102 are tapered and/or beveled for comfort. The body 102 is flexible to conform to the gripping preferences of a user.

Although the longitudinal end 106 that carries the marker tip 112 in the illustrated embodiment is tapered, and the opposite longitudinal end 104 extending away from the marker tip 112 is generally straight edged or linear, these descriptions relate as well to other embodiments having longitudinal ends that are both linear, tapered, semicircular and other shapes matched and unmatched.

Figure 2:
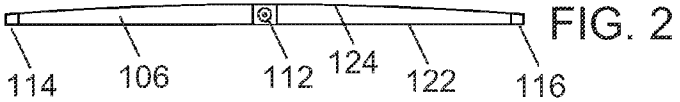
FIG. 2 is a longitudinal end view of the flexible marker of FIG. 1.

FIG. 2 is a longitudinal end view of the flexible marker 100 of FIG. 1. In the illustrated embodiment, a first face 122 of the body 102 is planar, and the opposite face 124 arches slightly from the lateral sides 114 and 116 to a body center line at a longitudinally extending axis 126 (FIG. 1) centrally located between the lateral sides 114 and 116, such that the body 102 is thicker along a longitudinally extending central portion than along the lateral sides 114 and 116.

The marker tip 112 represents a marking implement extended from or retracted within a central bore defined in the body along the longitudinal axis. The marking implement can be a ball point pen core implement, a felt tip marking tool, a mechanical pencil, a stylus, and any preferred marking implement and may be refillable. It may be mounted in a fixed relationship to the body 102 or it may include a mechanism by which it can be extended from and withdrawn into the body 102. For example, the marking implement may function like a click pen. The marker tip 112 of the marking implement extends in at least one example to about one quarter of an inch from the apex 110 of the longitudinal end 106 in its deployed configuration.

Figure 3:
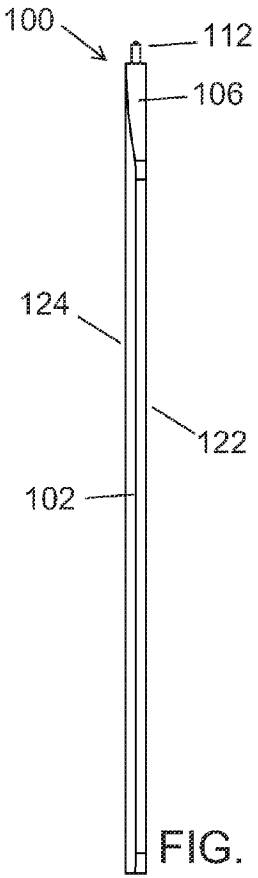
FIG. 3 is a lateral side view of the flexible marker of FIG. 1.

FIG. 3 is a lateral side view of the flexible marker of FIG. 1. FIG. 4 is a perspective view of the flexible marker 100 of FIG. 1. The body 102 is flexible and foldable according to the gripping preference of a user. The body 102 in at least one embodiment is flexible in portions along and near the central longitudinal axis 126. In particular, the body 102 can be flexed or folded to bring together the lateral sides 114 and 116. For example, the lateral side 114 can be flexed or folded around the central longitudinal axis 126 in the direction 130 (FIG. 4) toward the lateral side 116. Thus, flexed folded at the longitudinally extending axis 126, the flexible marker 100 is configured for use as a writing, drawing or other marking implement.

The body 102 in at least one embodiment is flexible in portions along and near one or more laterally extending axes. In particular, the body 102 can be flexed or folded to bring into close proximity the longitudinal ends 104 and 106. For example, the longitudinal end 104 can be flexed or folded around two laterally extending axes 134 and 136 in the direction 140 (FIG. 4) toward the longitudinal end 104 into two respective overlapping configurations. When unfolded, the flexible marker has a generally flat configuration as shown in the drawings.

When the body 102 is flexed or folded at the laterally extending axis 134, which is closer along the body to the longitudinal end 104 than the longitudinal end 106 with the marker tip 112, the longitudinal end 106 and marker tip 112 will overhang or extend beyond the longitudinal end 104, allowing use of the marker tip 112. Thus, flexed or folded at the laterally extending axis 134, the flexible marker 100 is configured for use as a writing, drawing or other marking implement.

When the body 102 is flexed or folded at the laterally extending axis 136, which is closer along the body to the longitudinal end 106 with the marker tip 112 than the longitudinal end 104, the longitudinal end 104 will overhang or extend beyond the longitudinal end 106 and marker tip 112, preventing use of the marker tip 112. Thus, flexed or folded at the laterally extending axis 136, the flexible marker 100 is configured for storage, for example in a wallet or pocket.

The directions 130 and 140 referenced in the drawings and these descriptions are at least partially perpendicular to the generally planar first face 122 of the body 102. In examples where the body 102 has no exactly planar side, the directions 130 and 140 can be understood as at least partially perpendicular to both the lateral sides 114 and 116 and longitudinal ends 104 and 106.

Pre-formed fold lines along the body at the longitudinal axis 126 and laterally extending axes 134 and 136 may assist a user in achieving such predetermined folds as described with reference to FIG. 4. The fold lines may be pre-formed as creases, perforations, materially thinned lines, and other fold-facilitating treatments and features.

Figure 6:
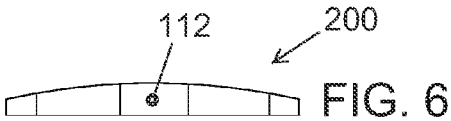
FIG. 6 is a longitudinal end view of the flexible marker of FIG. 5.
Figure 5:
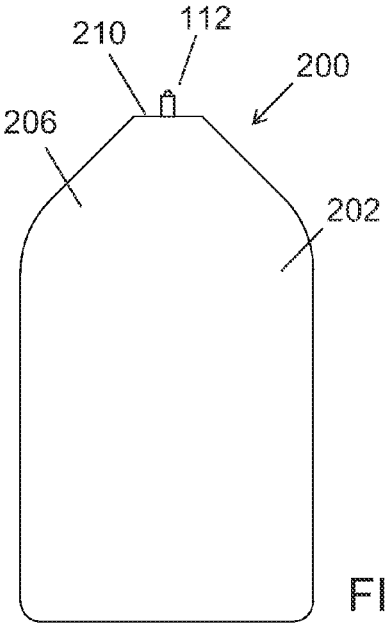
FIG. 5 is a plan view of a flexible marker according to another embodiment.
Figure 7:
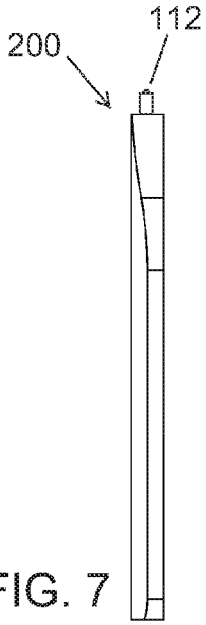
FIG. 7 is a lateral side view of the flexible marker of FIG. 5.

FIG. 5 is a plan view of a flexible marker 200 according to another embodiment. In FIG. 5, the apex 210 of the tapered longitudinal end 206 of the body 202 is widened relative to that of FIG. 1. FIG. 6 is a longitudinal end view of the flexible marker 200 of FIG. 5. FIG. 7 is a lateral side view of the flexible marker 200 of FIG. 5.

Although no particular dimensional measurements are expressly shown in the drawings, the flexible markers 100 and 200 have many different dimensional measurements. The examples illustrated in the drawings demonstrate that various flexible markers according to these descriptions and drawings can have various relative and absolute dimensions. Overall final dimensions of the flexible marker may be selected to fit inside a wallet or pocket so that the flexible marker is conveniently available at all times.

The bodies of the flexible markers according to these descriptions can be manufactured as layered constructions having external layers and internal layers, which may be skeletonized or may have relief areas for example to effect pre-formed fold tines or grip yielding areas.

Exemplary materials for the construction of the components of a flexible marker according to these descriptions include but are not limited to: foams such as PORON and others; acrylics; PET; PETG and other thermoplastics; single-sided and double-sided tapes; and both synthetic and natural materials. Manufacturing processes for the fabrication of a flexible marker according to these descriptions include but are not limited to: injection molding; extruding; 3D printing; die-cutting; and other automated and hand-assembly processes. In one example, a 3D printed acrylic interior mold is used.

Other materials and processes may be used in combination with or in alternative to the materials listed. Flexible and resilient materials are preferred so the flexible marker can be folded or formed for use as preferred and then return to its flat shape as shown in the drawings by shape memory resilience.

A flexible marker according to these descriptions may be used, for example, as a bookmark. Advertising and promotional information and graphical content may be applied to exterior surfaces of the flexible marker. For example, sport logos may appear on the outer surfaces of the flexible marker and companies may use the flexible markers to market their product and/or services by providing them as gifts to existing and potential customers.

The flexible marker is expected to be particularly advantageous for use to avoid carpal tunnel syndrome, and for use by persons recovering from or proactively avoiding hand injury. Those with disabilities are likely to find the flexible marker easier or more possible to use than conventional markers that do not adapt to a user's hand. The flexible marker can be wielded with a tight touch in comparison to stiff narrow-bodied conventional pens. In use, the way a user grips the flexible marker can change so that the hand is not limited to a single position, so fatigue and/or injury is avoided.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. A flexible marker comprising:

a flexible body for gripping, the flexible body comprising a first longitudinal end, a second longitudinal end, and two laterally extending pre-formed fold lines; and a marking implement carried at least partially within the body, the marking implement including a tip that extends outward from the first longitudinal end of the body, wherein the body is flexible to conform to the grip preferences of a user, and wherein the body can be configured into either one of two overlapping configurations by folding the body along or near either of two respective laterally extending pre-formed fold lines defined by the body.

2. A flexible marker according to claim 1, wherein the body has two parallel lateral sides and wherein the first longitudinal end is tapered and defines a central apex from which the tip of the marking implement extends.

3. A flexible marker according to claim 2, wherein the body is thicker along a longitudinally extending central portion than along the lateral sides.

4. A flexible marker according to claim 3, wherein the body comprises a generally planar face, and an arched face opposite the generally planar face.

5. A flexible marker according to claim 1, wherein the body includes two parallel lateral sides, and wherein the body can be folded along or near a longitudinally extending axis defined approximately centrally between the two parallel lateral sides.

6. A flexible marker according to claim 5, wherein a pre-formed fold line is defined by the body along the longitudinally extending axis.

7. A flexible marker according to claim 1, wherein when folded at a first of the two laterally extending pre-formed fold lines, the second longitudinal end of the body overhangs the tip of the marking implement to prevent use of the marking implement.

8. A flexible marker according to claim 7, wherein when folded at a second of the two laterally extending pre-formed fold lines, the tip of the marking implement extends longitudinally beyond the second longitudinal end of the body to permit use of the marking implement.

9. A flexible marker comprising:

a flexible panel having a first longitudinal end and a second longitudinal end, the flexible panel configurable between a generally flat configuration and at least one flexed or folded configuration; and a marking implement extendable from the first longitudinal end, wherein the flexible panel can be flexed or folded along a first laterally extending axis in a first configuration in which the marking implement extends longitudinally beyond the second longitudinal end for use of the marking implement.

10. A flexible marker according to claim 9, wherein the flexible panel can be flexed or folded along a longitudinal axis for use of the marking implement.

11. A flexible marker according to claim 9, wherein the flexible panel can be flexed or folded along a second laterally extending axis in a second configuration in which the second longitudinal end extends longitudinally beyond the marking implement.

12. A flexible marker according to claim 11, wherein the flexible panel defines a first laterally extending pre-formed fold line at the first laterally extending axis and a second laterally extending pre-formed fold line at the second laterally extending axis.

13. A flexible marker according to claim 9, wherein:

the body has two parallel lateral sides; and the first longitudinal end tapers from the two parallel lateral sides to a longitudinally extending central apex from which a tip of the marking implement is extendable.

14. A flexible marker according to claim 13, wherein the second longitudinal end is straight edged.

15. A flexible marker according to claim 9, wherein the flexible panel is thicker along a longitudinally extending central portion than along lateral sides.

16. A flexible marker according to claim 15, wherein the flexible panel comprises a generally planar face, and an arched face opposite the generally planar face.

* * * * *